US011506017B2

(12) United States Patent
Petrowsky

(10) Patent No.: US 11,506,017 B2
(45) Date of Patent: Nov. 22, 2022

(54) FIELD-ADJUSTABLE, SEAL-LESS FRANGIBLE DOWNHOLE PRESSURE CONTROL AND ISOLATION DEVICE AND SUBASSEMBLY FOR CONDUIT IN WELLBORE

(71) Applicant: ARMOR TOOLS INTERNATIONAL INC., Red Deer (CA)

(72) Inventor: Conrad Petrowsky, Red Deer (CA)

(73) Assignee: ARMOR TOOLS INTERNATIONAL INC., Red Deer (CA)

( * ) Notice: Subject to any disclaimer, the term of this patent is extended or adjusted under 35 U.S.C. 154(b) by 0 days.

(21) Appl. No.: 17/292,417

(22) PCT Filed: May 6, 2020

(86) PCT No.: PCT/CA2020/050619

§ 371 (c)(1),
(2) Date: May 7, 2021

(87) PCT Pub. No.: WO2020/223815

PCT Pub. Date: Nov. 12, 2020

(65) Prior Publication Data

US 2022/0090465 A1 Mar. 24, 2022

Related U.S. Application Data

(60) Provisional application No. 62/843,934, filed on May 6, 2019.

(51) Int. Cl.
*E21B 34/06* (2006.01)

(52) U.S. Cl.
CPC ..... *E21B 34/063* (2013.01)

(58) Field of Classification Search
CPC ..... E21B 34/063; E21B 34/08; E21B 34/14
See application file for complete search history.

(56) References Cited

U.S. PATENT DOCUMENTS 5,924,696 A * 7/1999 Frazier ..... E21B 34/063 277/336
9,593,542 B2 3/2017 Getzlaf et al.
2011/0315398 A1* 12/2011 Ueland ..... E21B 33/1208 166/376

(Continued)

FOREIGN PATENT DOCUMENTS

CA 2865667 A1 4/2015

OTHER PUBLICATIONS

PCT Application No. PCT/CA2020/050619 International Search Report and Written Opinion of the International Search Authority, dated Jul. 24, 2020.

*Primary Examiner* — Christopher J Sebesta
(74) *Attorney, Agent, or Firm* — Kunzler Bean & Adamson

(57) ABSTRACT

In well bores with included tubulars, it is often desirable to segregate a portion of the wellbore's pressure-driven fluid flowpath in the conduit portion formed by included tubulars to permit work to be completed in a pressure-controlled portion of that flowpath. The subassembly and included frangible device provided here does so with minimal exposure of seals to well fluid environments, and provides a field-adjustable variability to the pressure differentials required to open the conduit by removal of the frangible sealing device from the flowpath into which the subassembly is installed or included.

17 Claims, 14 Drawing Sheets

(56) References Cited

U.S. PATENT DOCUMENTS

| | | | | |
|---|---|---|---|---|
| 2014/0216756 | A1* | 8/2014 | Getzlaf | E21B 33/146<br>166/376 |
| 2017/0022783 | A1* | 1/2017 | Yong | H04L 41/0266 |
| 2017/0096875 | A1* | 4/2017 | Ravensbergen | E21B 17/012 |

* cited by examiner

FIELD-ADJUSTABLE, SEAL-LESS FRANGIBLE DOWNHOLE PRESSURE CONTROL AND ISOLATION DEVICE AND SUBASSEMBLY FOR CONDUIT IN WELLBORE

BACKGROUND OF THE INVENTION AND PRIOR ART

Prior art frangible seal systems have included frangible discs inserted within subassemblies installed in-line in wellbore tubulars. Those subassemblies were not field-adjustable, and required disassembly and reassembly of delicate (frangible) parts and seals to change the pressure-response characteristics of the seals. For instance, new discs would be needed to replace the prior disc, which would involve taking the subassembly apart, removing the frangible disc, and several o-ring and other seals, and then reassembling the subassembly with a new disc with different breaking and pressure control characteristics. Such disassembly and reassembly in the field without bench test equipment or controlled shop environments introduced increased risk of seal failure, and was not desirable, sometimes not permitted by well owners.

Prior art in-line pressure control systems with frangible disc seals have also typically been formed of subassemblies with multiple body pieces joined together, and included seals to ensure integrity of the flowpath within the assembly. Those seals were exposed to the wellbore fluid environment, and in some circumstances cause a need to replace the seals and subassembly when the wellbore fluid environment deteriorated the seals, making these subassemblies unsuitable for long-term placement (sealed or broken open) in the tubular string of the wellbore.

Some examples of prior art systems in this field are, for example:

U.S. patent application Ser. No. 15/829,696, which provides a disc-seal-carrying subassembly;

U.S. Pat. No. 5,924,696 which provides a disc-carrying subassembly.

U.S. Pat. No. 9,593,542 discloses a rupture disc held in place by a shear-ring with breakaway sections, the breakaway sections of the ring holding the rupture disc from sliding in the conduit of the tubing string. When sufficient pressure is asserted to the convex side of the rupture disc, the shear ring breakaway sections break, permitting the disc to slide and collide with a narrowed section of the conduit, which exerts an inward radial pressure on the disc causing it to burst. (NCS Oilfield Services). This shear ring is not field adjustable, and the system provides no piston or engagement ring features.

The device and subassembly of this invention overcomes certain deficiencies of the prior art, and is thus an improvement.

SUMMARY OF INVENTION

This invention provides a field adjustable downhole device to control pressures within zones of a wellbore and associated tubulars in the wellbore, by selectively segregating a portion of the wellbore and associated tubulars from another portion of the wellbore and associated tubulars, with some or all of the following features:

1. A tubular body with connection means enabling the body to be connected in-line with the associated wellbore tubular;

2. A hollow piston slideably moveable within the inner bore of the device body, with dynamic seals between the piston and the inner bore's inner surface; the piston having features (ledges, holes, grooves) into which détente means may extend or attach;
3. A piston détente means to hold the piston in place until pressure on one side of the piston exceeds a threshold pressure (the détente may be one or more shear pins engaged with both the device body and the piston), where the piston is moveable when the détente is released to slide within a cylinder formed by the inner bore of the device;
4. A breakable domed disc with a circular edge with a ledge, the disc's ledge set onto and sealed to one side of the piston, the body of the disc within the edge being exposed to the inner bore of the device body and dividing and segregating the inner bore into two volumes, each volume in fluid communication with wellbore tubulars' inner conduit attached to one side or the other of the device; the disc exposed on each side of the disc to fluid pressures exerted by fluid in the wellbore tubular connected to that (respective) side of the device;
5. The domed disc having a weakened portion in its body between: the junction of the edge of the concave domed surface of the disc body and the inner surface of the ledge; and a circumferential groove with a circumference approximately equal to the inner diameter of the ledge portion disposed about where the edge of the convex domed surface meets the outer surface of the ledge;
6. A guillotine disposed on a ledge inside the device's inner bore on one side of the disc toward the direction in which the piston is slideable when the détente is released; where the guillotine is of a shape and is positioned such that when the piston and its attached disc moves after the détente means release the piston to move, the surface of the disc inside the ledge strikes the guillotine and the disc is thereby impacted and broken away, permitting the inner bore of the device's body to become a flow-through conduit and ending the segregation of the tubular's inner conduit; the guillotine, being a cylindrical metal shape, which may be fitted with fluid vents at or near the end of the guillotine away from the end of the guillotine which strikes the disc, to permit any fluid displaced by movement of the piston to escape via the vents into the central bore of the device body, and not act against the piston's movement
7. The disc being held, sealed and attached to the piston by at least a lo-hi seal on one side of the disc between the piston and the disc's ledge , and a vented centering and seating ring, and an engagement ring which is threadably attached to the inner bore of the device, on the other side of the disc's ledge; the engagement ring having an internal opening with an inside diameter slightly larger than the outside diameter of the guillotine;
8. As an alternative, the body of the device may be in multiple parts which may be detached and re-attached, whereby attachment of one part may hold and seal the disc, lo-hi seal, vented centering and seating ring to the piston, the joint between parts of the body assembly taking the role of the engagement ring;
9. When the disc is broken, its ledge is captured between the outer surface of the guillotine and a recessed inner surface of the inner bore, and a radial surface of the engagement ring, thus keeping that part of the breakable disc seal's body from entering the wellbore's conduit formed in the tubular; a thin-walled steel ring could be inserted inside the disc ledge, sized to permit the guillotine to strike the disc body, but otherwise to isolate the ceramic ledge part of the disc seal to be captured and held away from the tubular's inner bore and conduit flowpath after the disc breaks away (by striking the guillotine blade);

10. The détente means is field adjustable without completely disassembling the downhole device by changing the amount of force the détente means will resist before releasing the piston (by changing the number or composition of shear pins installed holding the piston in détente with the device body, which may be done from external ports in the body, or internal ports through the piston's wall and into the device's body); the shear pins (for example) may be inserted from the outer surface of the body and extend inwardly through the body and into a mating aperture (slot, hole) in the piston's diametrically outer surface; if from the outside, the piston may be inserted and mechanically sealed to the body by friction (e.g. pin may be slightly tapered to wedge into a mating hole in the body, deform and seal to the body by being forced into place; alternatively, the pin may be threaded and screwed into mating threads in the body's wall and into a slot or aperture in the piston;
11. Inside the inner bore of the device there is a space or volume provided into which the piston can move when it slides after the détente is released, which is outside the outside surface of the guillotine, and thus is bounded by an end of the piston away from the disc, the inner bore of the device, the outer surface of the guillotine, and a stop ledge which limits the piston's travel; this void is vented by holes through the body of the guillotine adjacent the void in communication between the void and the inner conduit of the device;
12. The device's body may be a single tubular part, or may be more than one part fitted together, in which case a first part may comprise a wall and bore with the ledge to hold the guillotine and the piston held by the détente means; and a second part may form a cylinder to surround and hold the disc, seal, vented centering and seating ring in place above the piston; those two parts may be assembled in sealed attachment to each other by threading mating portions of the two parts;
13. Where the body is a single component holding the disc or multiple discs to act as a seal element, threaded attachment means for attaching to and inline in the associated wellbore tubular are provided at each end of the body; this permits the device to be assembled without seals exposed to the harsh environment of the wellbore fluids, which is a significant method of extending the in-hole lifespan of the utility of the device over prior art pressure control devices with exposed seals (o-rings, etc), without requiring expensive or complex gas-tight threads or special materials;
14. The bore of the body (i.e. its inside passage through which the piston fits, has a slightly larger inner diameter than the outer diameter of the piston, and the gap between the two (body and piston) parts may be sealed from fluid communication using o-rings or similar seals;
15. The device may comprise back-to-back breakable pressure-holding disc seals, either or both in the configuration above, but generally one with the above guillotine and one with a pressure-breakable disc.

The invention also encompasses uses of the device described above and herein, including: A. a method of operating a wellbore in a monobore completion, comprising the use of the device of this invention in the steps of:

a. injecting a tubing string into a vertical portion of a wellbore partway;
b. adding inline into the tubing string the device of this invention;
c. injecting the tubing string and the included device further into the wellbore
d. adding to the tubing string and the wellbore an annular packer or seal device
e. injecting the tubing, the included device of this invention and the packer or seal further into the wellbore
f. actuating the packer or seal to seal the annulus between the tubular and the wellbore to set the packer and form the annular seal at a desired depth into the wellbore
g. injecting fluid against the disc of the invention at a pressure which releases the détente means of the device and causes the disc to impact the guillotine of the device to break the disc and open the inner conduit of the tubular.

B. a method of operating a wellbore to float tubing and associated equipment into the deviated lower part of a deviated or horizontal wellbore, comprising the steps of:

a. adding a one-way removable seal being the device of this invention, with its high-pressure side (convex side of its included disc-on-piston) toward bottom of the wellbore, to the bottom of a tubing string and injecting the tubing string into the wellbore
b. filling the conduit of the tubing string with a low density fluid such as air or some NCG, and adding another one-way removable seal being the device of this invention, with its high-pressure side toward bottom hole
c. injecting the tubing string and included low density fluid and two removable seal devices of this invention, a further pre-determined distance into the wellbore, adding high density fluid such as drilling fluid, water or weighed fluid into the conduit of the tubing string above the highest seal device of this invention in the tubing string to provide gravity assist to the injection of the tubing into the deviated or horizontal portion of the wellbore
d. with the tubing string in a desired position in the well, operating surface equipment to assert pressure onto one side of the uppermost device sufficient to release the détente and break away the disc seal by moving the piston and disc so that the disc strikes the guillotine of the device;
e. in some cases, then continuing to assert pressure in the tubing conduit sufficient to release the détente and breakaway the disc seal of the lowermost device of this invention;
f. thereby (with either step d or both steps d and e) opening the conduit for further operations.

C. Similarly, the device may be used to isolate a portion of the tubing string so that that portion may be filled with fluid during injection or other operations to prevent the collapse of the tubing in high pressure wells (known as billit).

E. Similarly, a two-disc opposing-disc set of disc seals including at least one of the devices of this invention may be used to isolate and pressure test the setting of a packer removing one disc by first applying pressure from equipment at surface to break one disc, then testing the packer, and then removing the second disc by further application of pressure from surface.

DETAILED DESCRIPTION

Figure 1A:
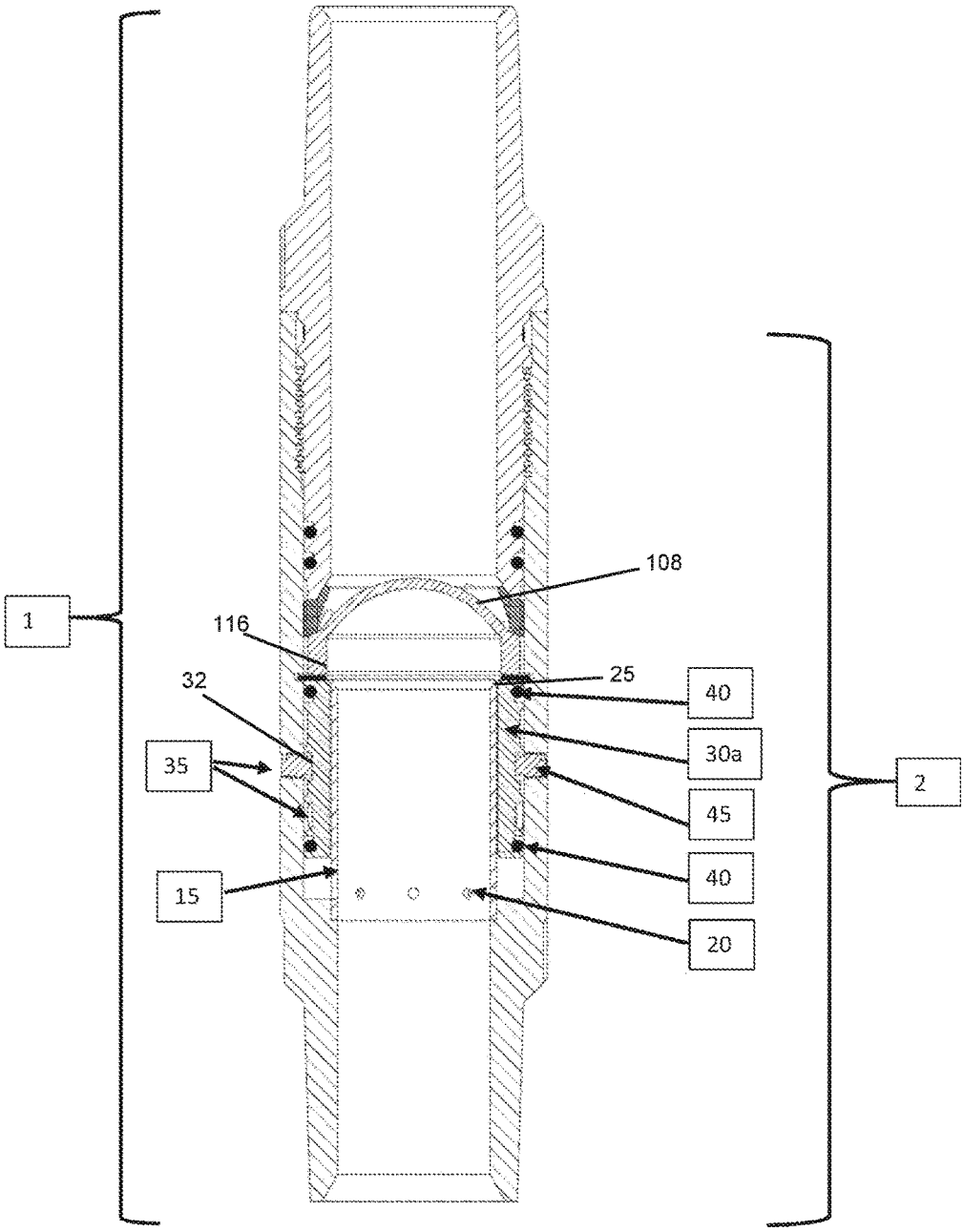
FIG. 1*a* is a longitudinal cutaway or cross-section of a two-part body style subassembly with external field-refittable shear pins, ready for deployment in a well.
Figure 1B:
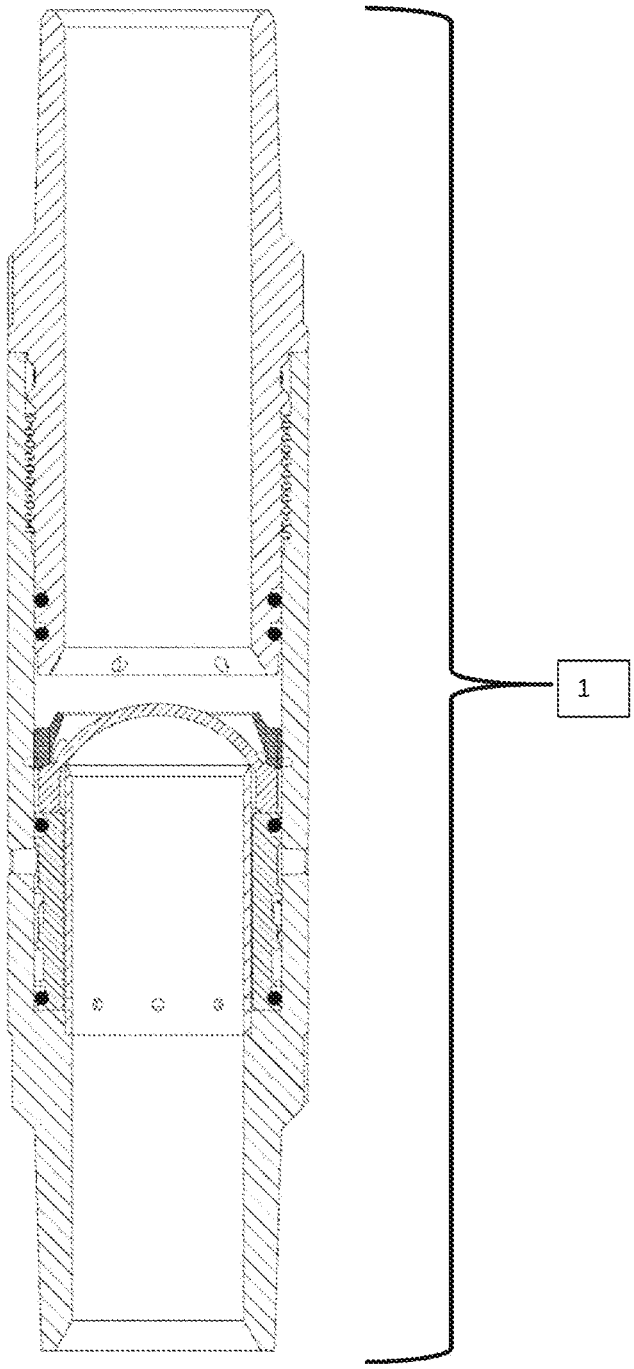
FIG. 1*b* is a cross-section of the subassembly of FIG. 1*a* with détente means released and piston striking guillotine, in other words, a piston activated sub disc striking the guillotine
Figure 1C:
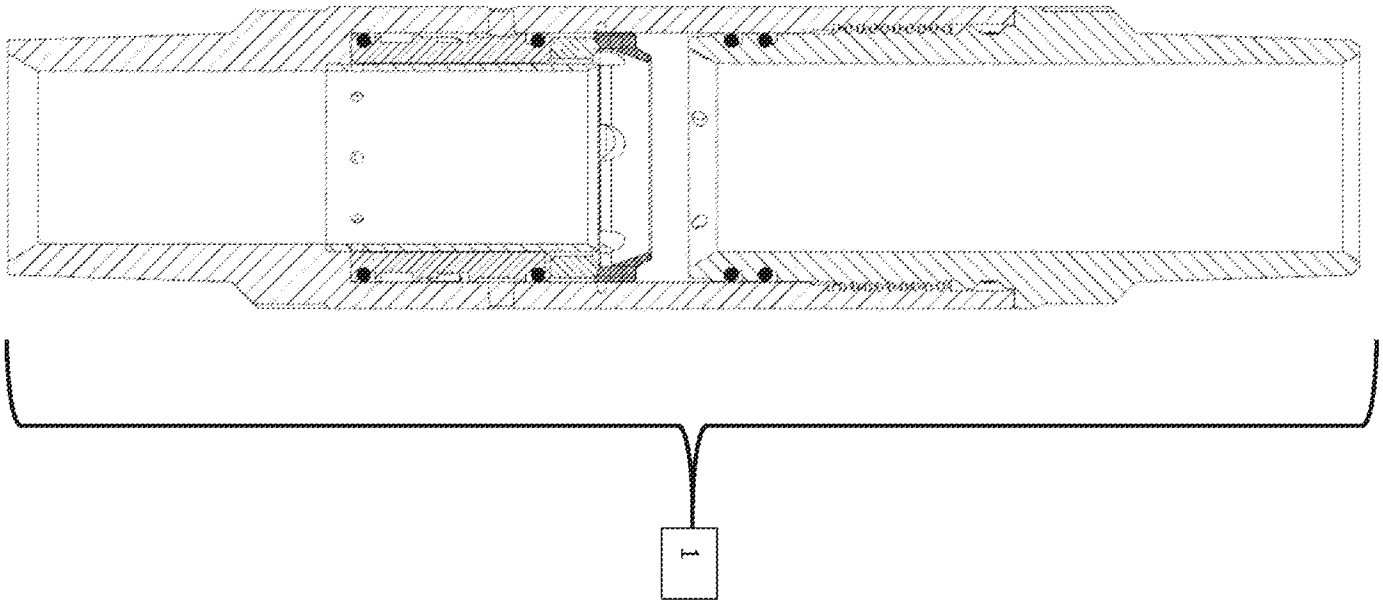
FIG. 1*c* is a cross-section of the subassembly of FIG. 1*a* with the pressure control frangible seal removed after striking the guillotine, showing an open tubular flowpath through the subassembly, wherein the disc dome has been ruptured
Figure 1D:
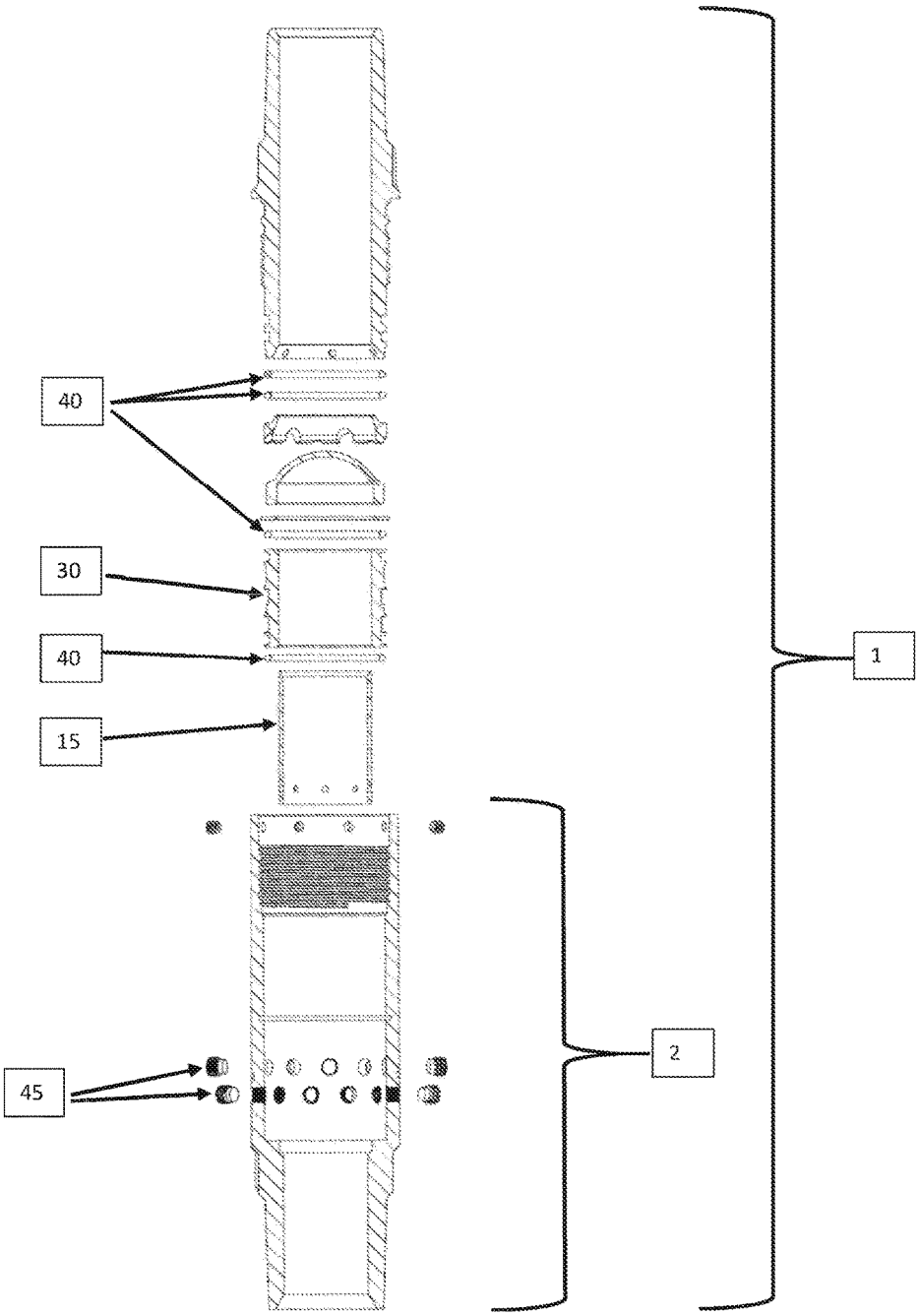
FIG. 1*d* is an exploded view of the operative components of the subassembly of FIG. 1*a*
Figure 2A:
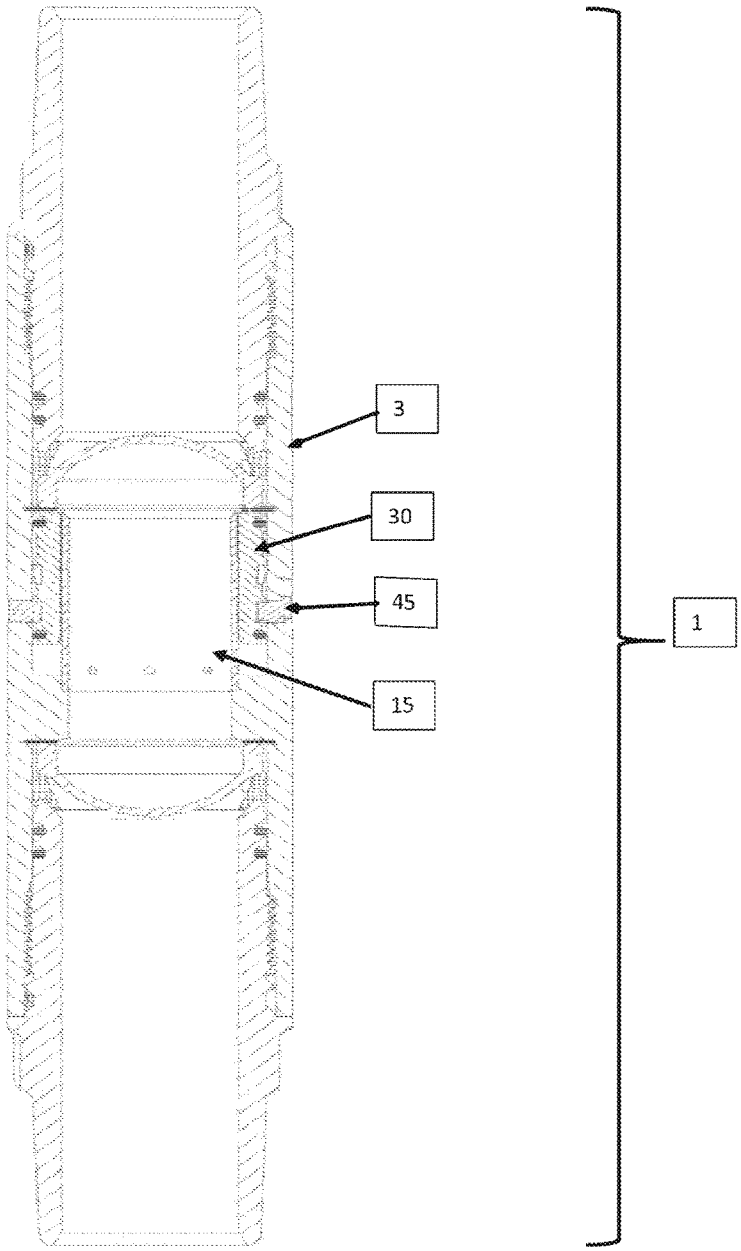
FIG. 2*a* is a cross-section of a two-frangible-seal subassembly, one disc seal being moveable for opening against a guillotine, where the disc seals are retained by second and third parts of the subassembly affixed to either end of the main part of its body
Figure 2B:
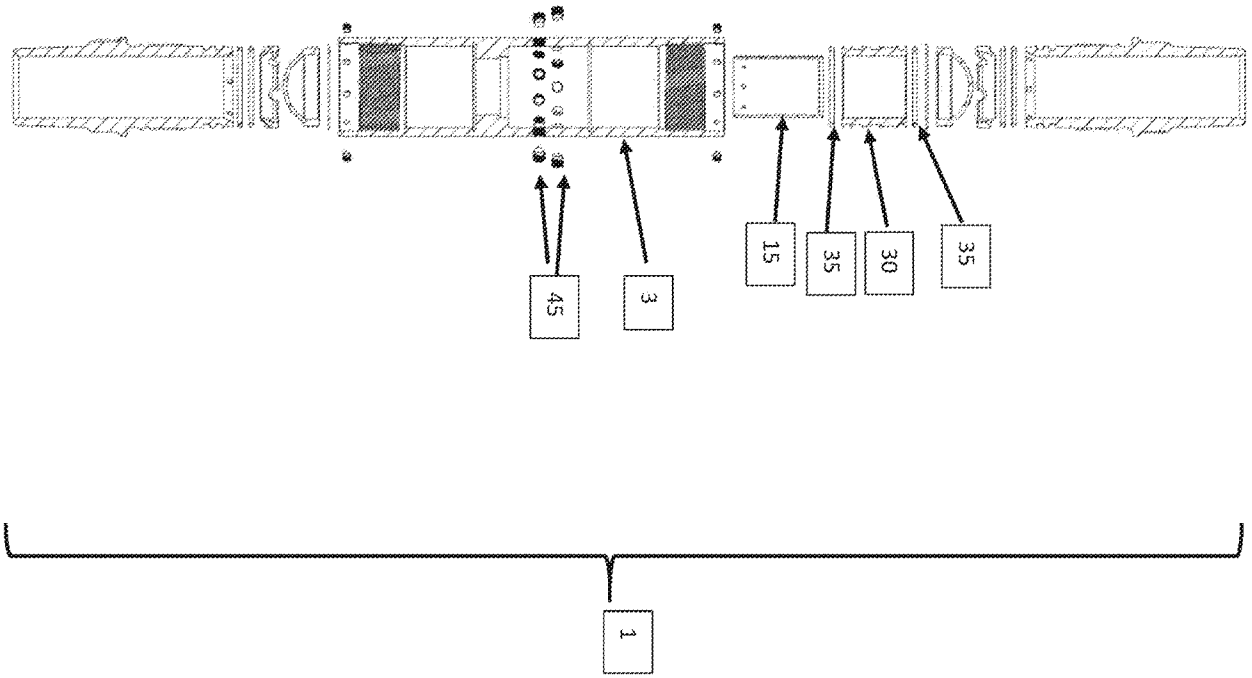
FIG. 2*b* is an exploded view of the components of the subassembly of FIG. 2*a*
Figure 3A:
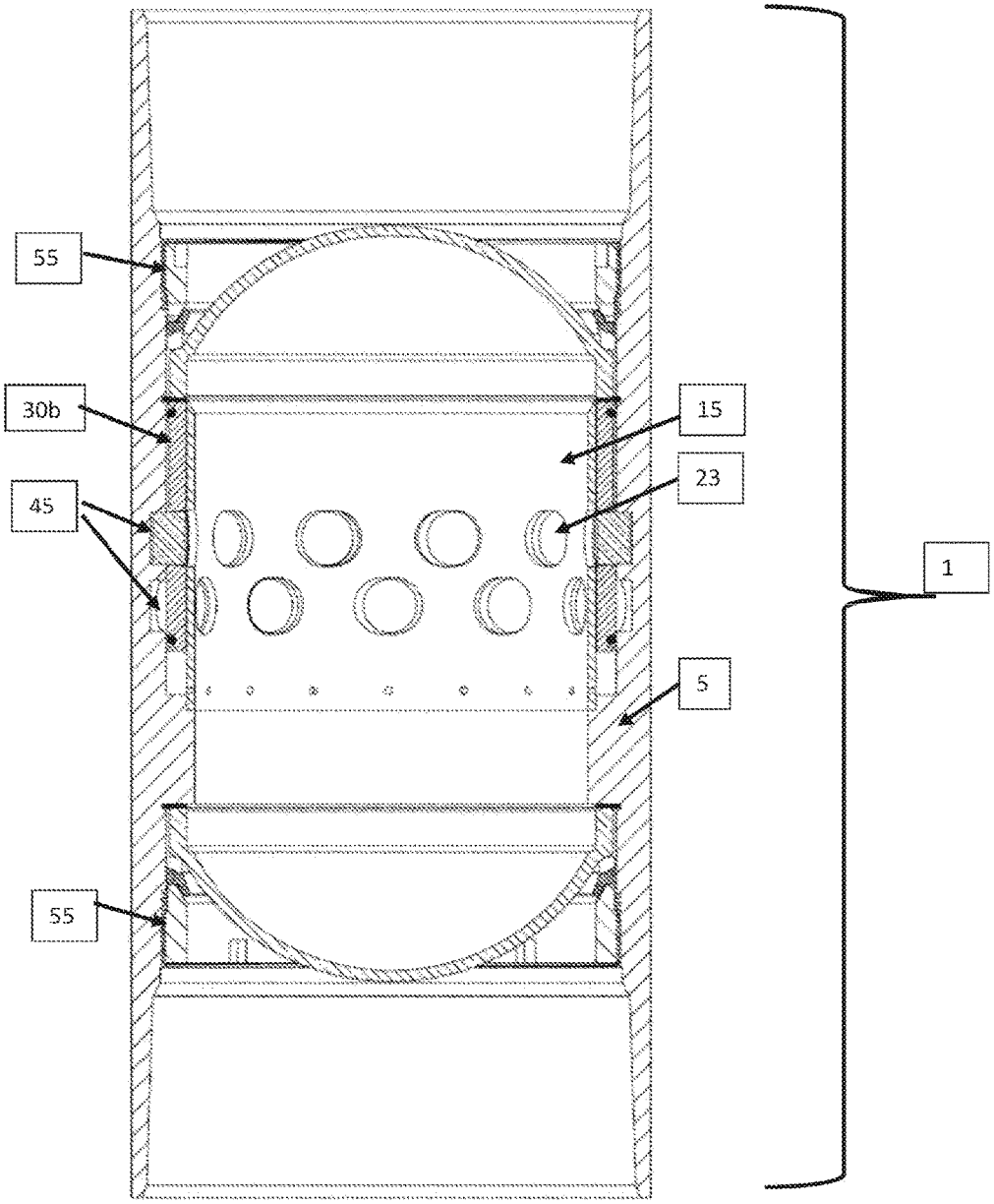
FIG. 3*a* is a cross-section of a seal-less subassembly with two frangible-disc seals, one disc on a moveable piston with pressure retention being field adjustable from inside the subassembly body
Figure 3B:
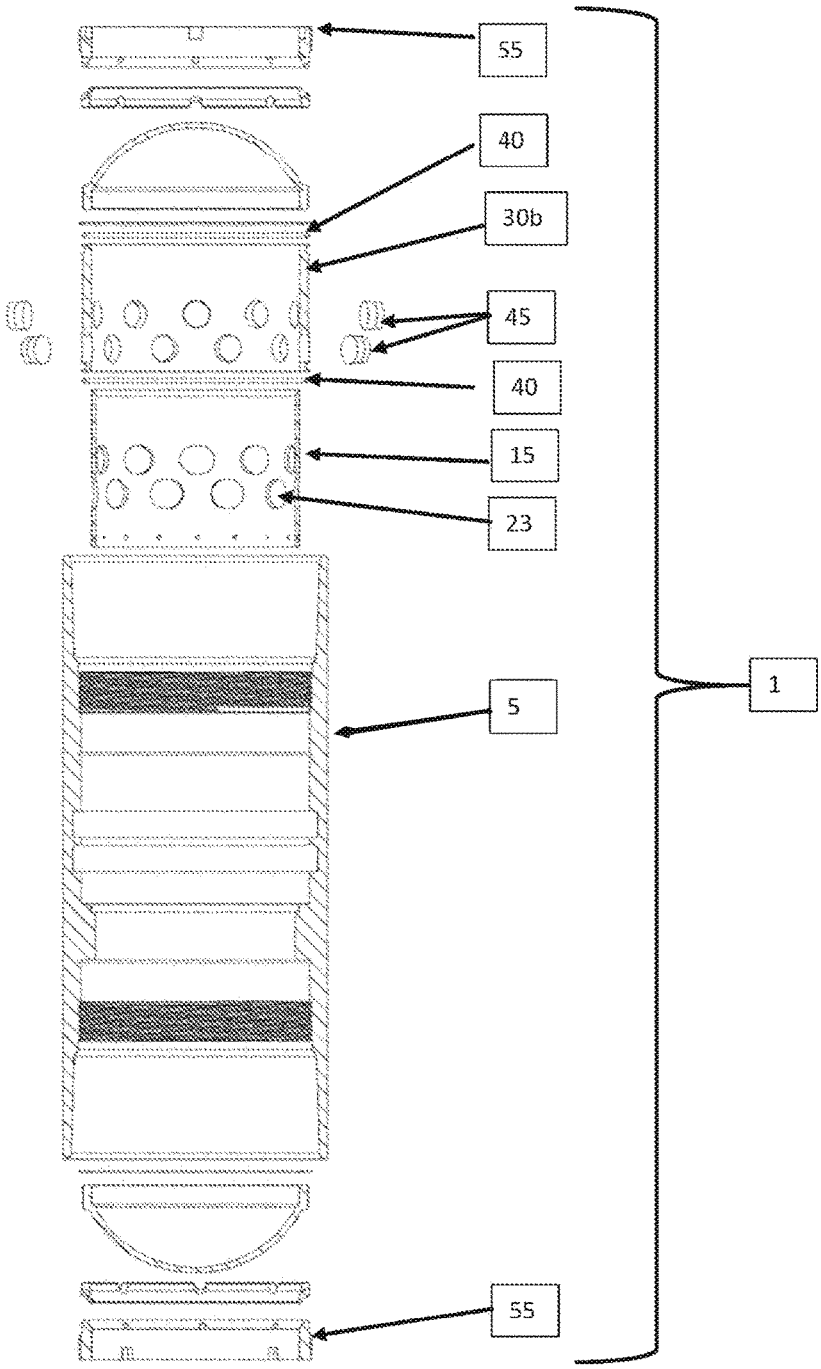
FIG. 3*b* is an exploded view of the components of the subassembly of FIG. 3*a*

In well bores with included tubulars, it is often desirable to segregate a portion of the wellbore's pressure-driven fluid flow-path in the conduit portion formed by included tubulars to permit work to be completed in a pressure-controlled portion of that flow-path. The subassembly and included frangible device provided here does so with minimal exposure of seals to well fluid environments, and provides a field-adjustable variability to the pressure differentials required to open the conduit by removal of the frangible sealing device from the flowpath into which the subassembly is installed or included For the reader's ease of reference, the following legend to the reference numbers in the drawings is provided:

| | |
|---|---|
| 1 | Field adjustable non-integral single disc subassembly |
| 2 | Guillotine/Piston assembly-single non-integral sub |
| 3 | Guillotine/Piston assembly-dual, non-integral |
| 5 | Guillotine/Piston assembly-dual disc, seal-less, integral |
| 6 | Guillotine/Piston assembly-single disc, seal-less, integral |
| 10a | Tapered shear pin (détente) |
| 10b | Threaded shear pin/screw (détente) |
| 15, 15a | Guillotine |
| 15b | Alternative Guillotine with internal access ports |
| 20 | Venting holes |
| 23 | Shear pin/screw access port |
| 30, 30a | Piston |
| 30b | Alternative Piston |
| 35 | Shear pin guides |
| 40 | Piston o-rings |
| 45 | Shear pins/screws |
| 55 | Engagement or engaging ring |

This invention provides a field adjustable downhole device to control pressures within zones of a wellbore and associated tubulars in the wellbore, by selectively segregating a portion of the wellbore and associated tubulars from another portion of the wellbore and associated tubulars, with some or all of the following features:

A tubular body with connection means enabling the body to be connected in-line with the associated wellbore tubular;

1. A hollow piston slideably moveable within the inner bore of the device body, with dynamic seals between the piston and the inner bore's inner surface; the piston having features (ledges, holes, grooves) into which détente means may extend or attach;
2. A piston détente means to hold the piston in place until pressure on one side of the piston exceeds a threshold pressure (the détente may be one or more shear pins engaged with both the device body and the piston), where the piston is moveable when the détente is released to slide within a cylinder formed by the inner bore of the device;
3. A breakable domed disc with a circular edge with a ledge, the disc's ledge set onto and sealed to one side of the piston, the body of the disc within the edge being exposed to the inner bore of the device body and dividing and segregating the inner bore into two volumes, each volume in fluid communication with wellbore tubulars' inner conduit attached to one side or the other of the device; the disc exposed on each side of the disc to fluid pressures exerted by fluid in the wellbore tubular connected to that (respective) side of the device;
4. The domed disc having a weakened portion in its body between: the junction of the edge of the concave domed surface of the disc body and the inner surface of the ledge; and a circumferential groove with a circumference approximately equal to the inner diameter of the ledge portion disposed about where the edge of the convex domed surface meets the outer surface of the ledge;
5. A guillotine disposed on a ledge inside the device's inner bore on one side of the disc toward the direction in which the piston is slideable when the détente is released; where the guillotine is of a shape and is positioned such that when the piston and its attached disc moves after the détente means release the piston to move, the surface of the disc inside the ledge strikes the guillotine and the disc is thereby impacted and broken away, permitting the inner bore of the device's body to become a flow-through conduit and ending the segregation of the tubular's inner conduit; the guillotine, being a cylindrical metal shape, which may be fitted with fluid vents at or near the end of the guillotine away from the end of the guillotine which strikes the disc, to permit any fluid displaced by movement of the piston to escape via the vents into the central bore of the device body, and not act against the piston's movement 6. The disc being held, sealed and attached to the piston by at least a lo-hi seal on one side of the disc between the piston and the disc's ledge , and a vented centering and seating ring, and an engagement ring which is threadably attached to the inner bore of the device, on the other side of the disc's ledge; the engagement ring having an internal opening with an inside diameter slightly larger than the outside diameter of the guillotine;
7. As an alternative, the body of the device may be in multiple parts which may be detached and re-attached, whereby attachment of one part may hold and seal the disc, lo-hi seal, vented centering and seating ring to the piston, the joint between parts of the body assembly taking the role of the engagement ring;
8. When the disc is broken, its ledge is captured between the outer surface of the guillotine and a recessed inner surface of the inner bore, and a radial surface of the engagement ring, thus keeping that part of the breakable disc seal's body from entering the wellbore's conduit formed in the tubular; a thin-walled steel ring could be inserted inside the disc ledge, sized to permit the guillotine to strike the disc body, but otherwise to isolate the ceramic ledge part of the disc seal to be captured and held away from the tubular's inner bore and conduit flowpath after the disc breaks away (by striking the guillotine blade);
9. The détente means is field adjustable without completely disassembling the downhole device by changing the amount of force the détente means will resist before releasing the piston (by changing the number or composition of shear pins installed holding the piston in détente with the device body, which may be done from external ports in the body, or internal ports through the piston's wall and into the device's body); the shear pins (for example) may be inserted from the outer surface of the body and extend inwardly through the body and into a mating aperture (slot, hole) in the piston's diametrically outer surface; if from the outside, the piston may be inserted and mechanically sealed to the body by friction (e.g. pin may be slightly tapered to wedge into a mating hole in the body, deform and seal to the body by being forced into place; alternatively, the pin may be threaded and screwed into mating threads in the body's wall and into a slot or aperture in the piston;
10. Inside the inner bore of the device there is a space or volume provided into which the piston can move when it slides after the détente is released, which is outside the outside surface of the guillotine, and thus is bounded by an end of the piston away from the disc, the inner bore of the device, the outer surface of the guillotine, and a stop ledge which limits the piston's travel; this void is vented by holes through the body of the guillotine adjacent the void in communication between the void and the inner conduit of the device;
11. The device's body may be a single tubular part, or may be more than one part fitted together, in which case a first part may comprise a wall and bore with the ledge to hold the guillotine and the piston held by the détente means; and a second part may form a cylinder to surround and hold the disc, seal, vented centering and seating ring in place above the piston; those two parts may be assembled in sealed attachment to each other by threading mating portions of the two parts;
12. Where the body is a single component holding the disc or multiple discs to act as a seal element, threaded attachment means for attaching to and inline in the associated wellbore tubular are provided at each end of the body; this permits the device to be assembled without seals exposed to the harsh environment of the wellbore fluids, which is a significant method of extending the in-hole lifespan of the utility of the device over prior art pressure control devices with exposed seals (o-rings, etc), without requiring expensive or complex gas-tight threads or special materials;
13. The bore of the body (i.e. its inside passage through which the piston fits, has a slightly larger inner diameter than the outer diameter of the piston, and the gap between the two (body and piston) parts may be sealed from fluid communication using o-rings or similar seals;
14. The device may comprise back-to-back breakable pressure-holding disc seals, either or both in the configuration above, but generally one with the above guillotine and one with a pressure-breakable disc.

The invention also encompasses uses of the device described above and herein, including:

A. a method of operating a wellbore in a monobore completion, comprising the use of the device of this invention in the steps of:

h. injecting a tubing string into a vertical portion of a wellbore partway;
i. adding inline into the tubing string the device of this invention;
j. injecting the tubing string and the included device further into the wellbore
k. adding to the tubing string and the wellbore an annular packer or seal device
l. injecting the tubing, the included device of this invention and the packer or seal further into the wellbore
m. actuating the packer or seal to seal the annulus between the tubular and the wellbore to set the packer and form the annular seal at a desired depth into the wellbore
n. injecting fluid against the disc of the invention at a pressure which releases the détente means of the device and causes the disc to impact the guillotine of the device to break the disc and open the inner conduit of the tubular.

B. a method of operating a wellbore to float tubing and associated equipment into the deviated lower part of a deviated or horizontal wellbore, comprising the steps of:

a. adding a one-way removable seal being the device of this invention, with its high-pressure side (convex side of its included disc-on-piston) toward bottom of the wellbore, to the bottom of a tubing string and injecting the tubing string into the wellbore
b. filling the conduit of the tubing string with a low density fluid such as air or some NCG, and adding another one-way removable seal being the device of this invention, with its high-pressure side toward bottom hole
c. injecting the tubing string and included low density fluid and two removable seal devices of this invention, a further pre-determined distance into the wellbore, adding high density fluid such as drilling fluid, water or weighed fluid into the conduit of the tubing string above the highest seal device of this invention in the tubing string to provide gravity assist to the injection of the tubing into the deviated or horizontal portion of the wellbore d. with the tubing string in a desired position in the well, operating surface equipment to assert pressure onto one side of the uppermost device sufficient to release the détente and break away the disc seal by moving the piston and disc so that the disc strikes the guillotine of the device;

e. in some cases, then continuing to assert pressure in the tubing conduit sufficient to release the détente and breakaway the disc seal of the lowermost device of this invention;

f. thereby (with either step d or both steps d and e) opening the conduit for further operations.

C. Similarly, the device may be used to isolate a portion of the tubing string so that that portion may be filled with fluid during injection or other operations to prevent the collapse of the tubing in high pressure wells (known as billit).

Figure 4A:
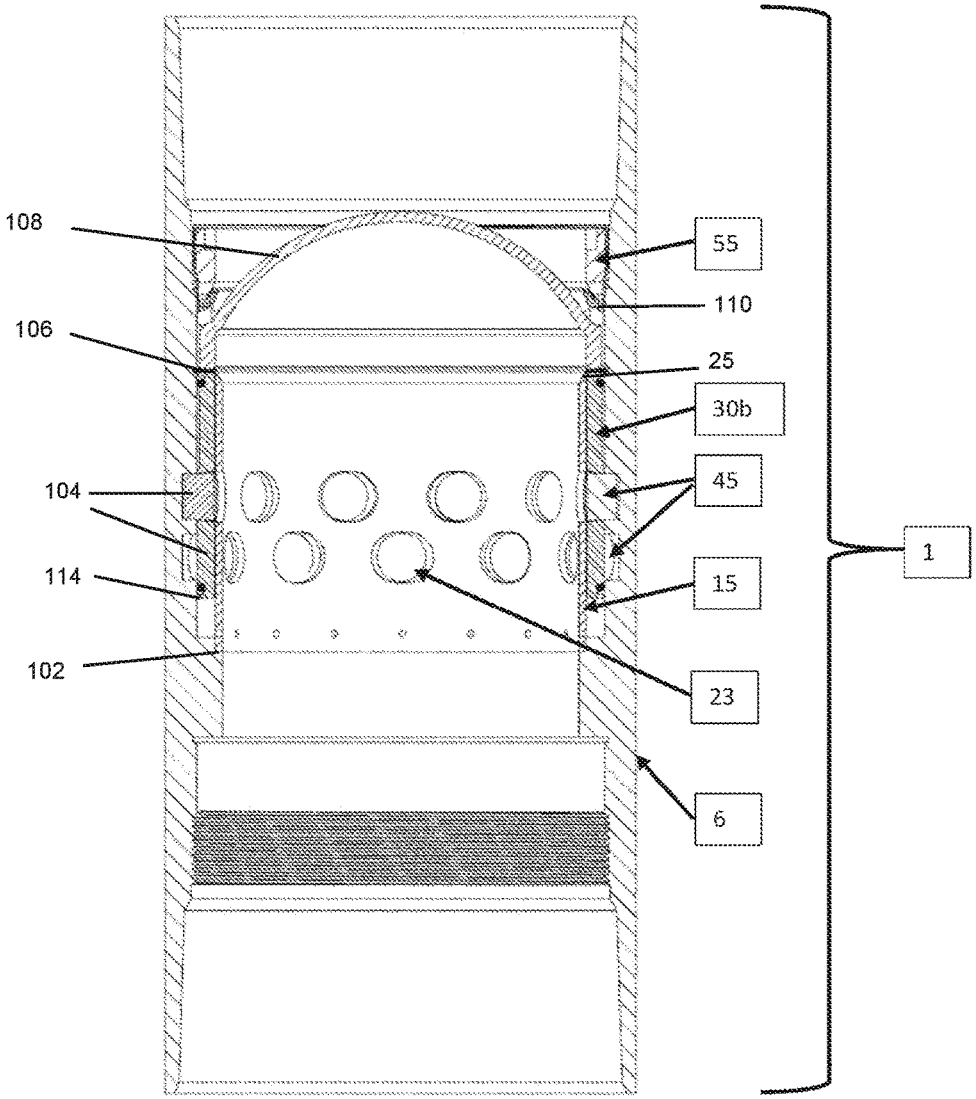
FIG. 4*a* is a cross-section of another embodiment of a seal-less subassembly similar to the one shown in FIG. 3*a*.
Figure 4B:
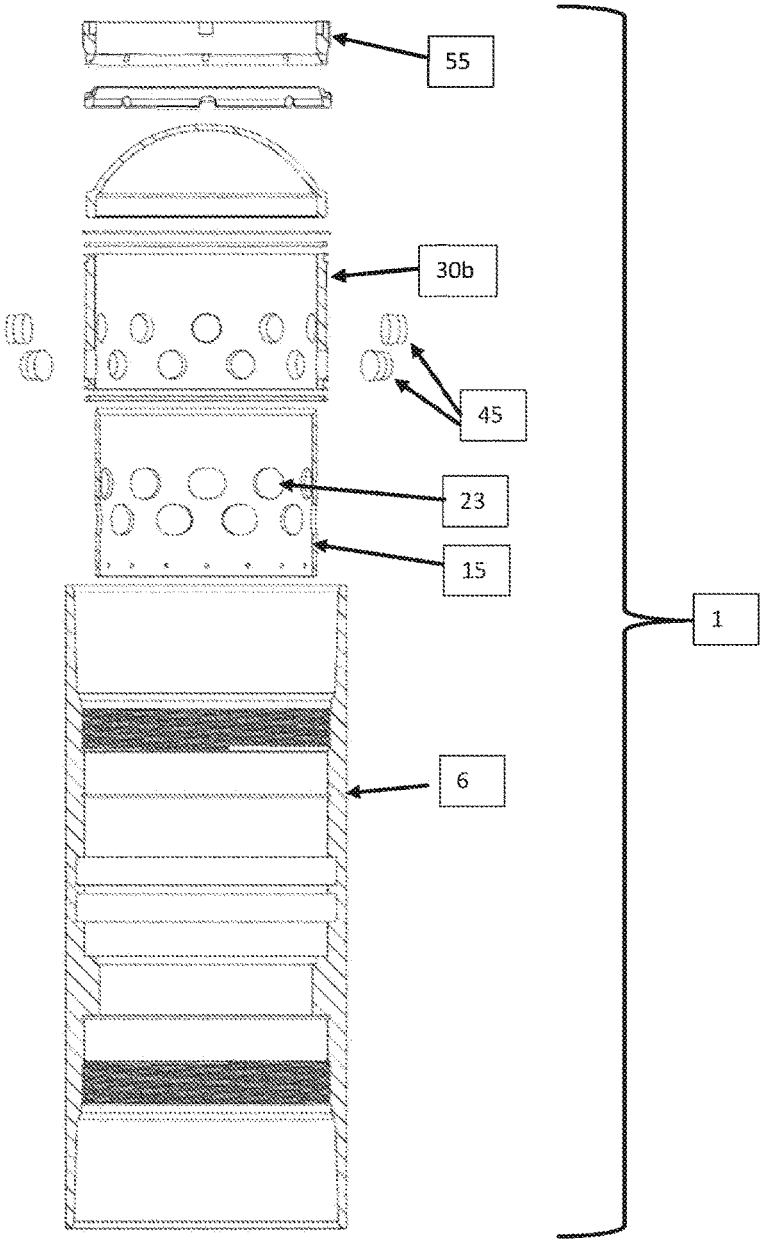
FIG. 4*b* is an exploded view of the subassembly of FIG. 4*a*
Figure 5:
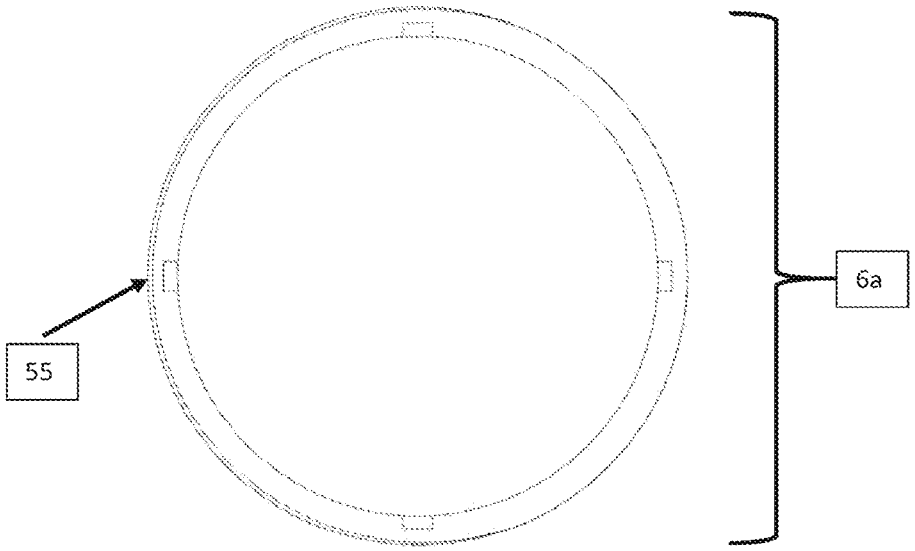
FIG. 5 shows two views of the body of an engagement ring (or engaging lock ring), top view 6*a* and side view 6*b*
Figure 5:
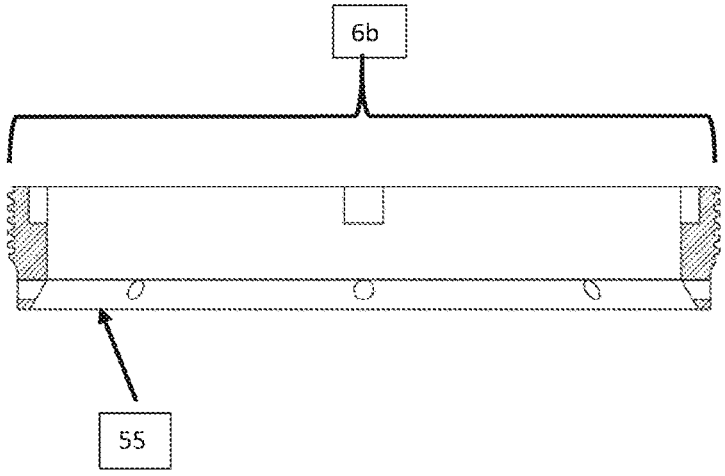
Figure 6:
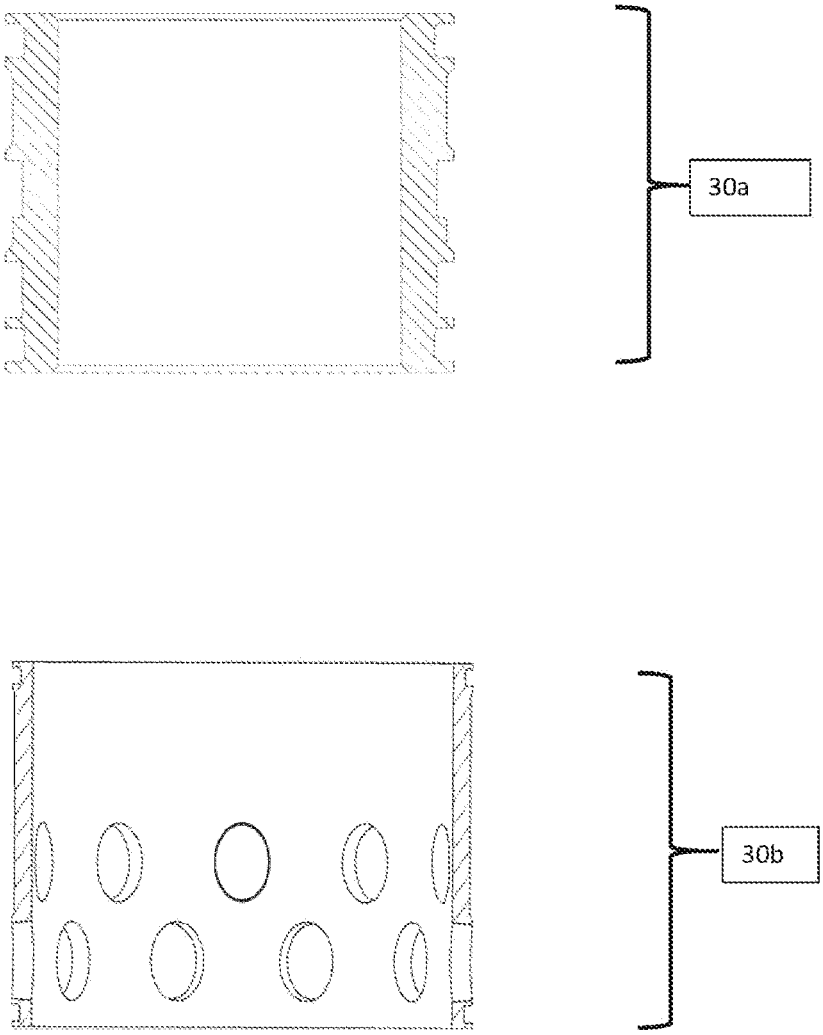
FIG. 6 shows two cutaway versions of the piston, one for exteriorly installed détente means 15*a*, the other a cutaway side view of a piston for internally installed détente means via ports or cutouts in the wall 15*b*
Figure 7:
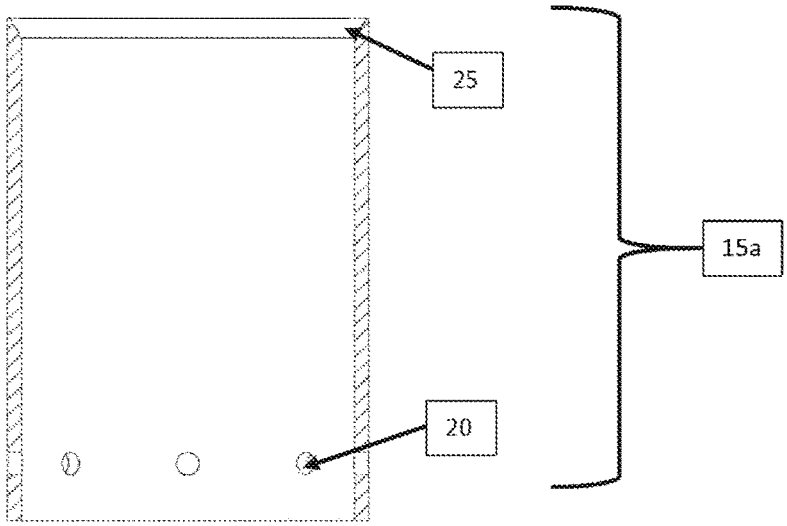
FIG. 7 shows a tubular guillotine in cutaway with vent holes and sharpened striking edge 15*a*, and with interior opening
Figure 7:
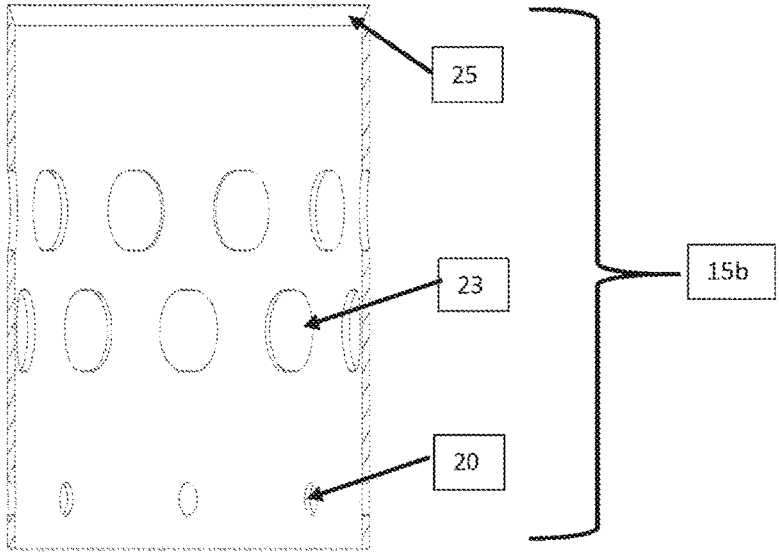
Figure 8:
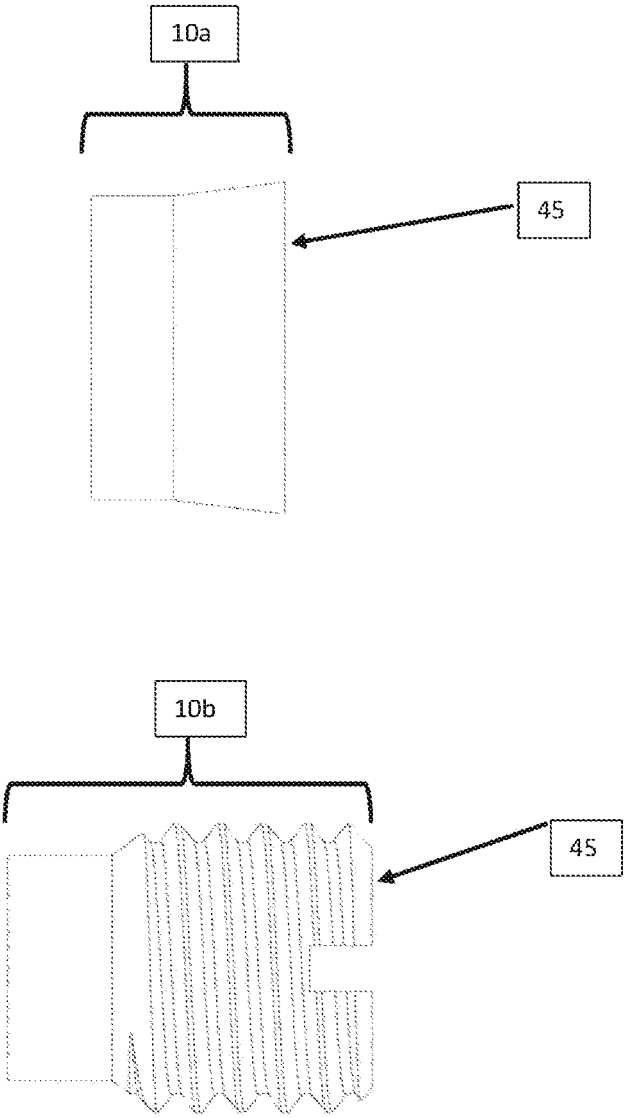
FIG. 8 shows two variants of shear pins which may be used as détente means between the piston and the body of the subassembly

E. Similarly, a two-disc opposing-disc set of disc seals including at least one of the devices of this invention may be used to isolate and pressure test the setting of a packer removing one disc by first applying pressure from equipment at surface to break one disc, then testing the packer, and then removing the second disc by further application of pressure from surface. As an example of the device of the invention, a field adjustable pressure subassembly 1 is provided at FIGS. 4*a* and 4*b*, which includes the following parts: the subassembly body 6 into which a tubular guillotine 15 is fitted to rest on a ledge (102) on its blunt end. A cylindrical piston 30*b* is fitted over the guillotine's external surface into the bore of the body 6 part way, until access ports 23 in the guillotine line up with receptacles 45 to receive shear pins 104. A burst-disc subassembly of lo-hi seal 106, disc 108, seating and centering ring 110 and engagement ring 55 are in turn assembled into the subassembly body 6 so that the disc subassembly sits on and is held in place by the piston's edge 114 furthest from the guillotine's sharpened striking edge 25.

To adjust the strength or holding power of the détente means, in this example the shear pins, shear pins or screws of different shear characteristics may be removed, installed, re-installed in the field by loosening the engagement ring 55, removing the burst-disc subassembly components, in order: engagement ring 55, seating and centering ring 110, disc 108 and thus gaining direct access via the bore of the assembly body 6 through the inside of the guillotine 15 and piston 30*b* and access ports 23 to the shear pin locations 23 to adjust, change out, remove, or place or replace shear pins. The subassembly may then be reassembled (assembly steps in reverse order).

Similarly, by example, the field adjustable pressure subassembly 1 in FIG. 1*a* provides for field adjustable strength or holding power (pressure differential held until a predesigned desired differential is imposed on the slideable disc/piston 2) by enabling the shear pins 45 to be field retrofitted, replaced, or removed from the exterior surface of the subassembly by an operator. The piston, in this example 30*a* will have external features (in this case circumferential grooves 32 or slots) in the external outer circumferential surface of the piston 30*a* into which shear pins 45 may be inserted from outside the body of the subassembly, to interfere with the piston's sliding movement until sheared. Once sheared, a second shear pin guide groove can accommodate deformed shear pin material so that the piston's sliding motion is not impaired.

It is to be noted that the inner diameter of the disc ledge 116 is slightly larger than the outer diameter of the guillotine 15 at its cutting end 25, and that the guillotine 15 is meant to be struck by the disc 108 at the desigdisc's body described above.

The invention claimed is:

1. A pressure control apparatus, comprising:

a tubular body with connection means enabling the body to be connected in-line with a wellbore tubular at an interface;

a hollow piston slideably moveable within an inner bore of the body, dynamic seals being between the piston and the inner bore's inner surface; the piston having features, including one or more ledges, holes, or grooves, into which a détente may extend or attach;

the détente, being field serviceable without complete disassembly of the apparatus, for holding the piston in place until pressure on one side of the piston exceeds a threshold pressure;

the piston being moveable when the détente is released to slide within a cylinder formed by the inner bore;

the détente including one or more pins engageable with the body and the piston, having a tool access port in the apparatus' body associated with each pin, to enable the removal, replacement or refitting of the associated pin via the associated access port in the body;

a disc, being breakable and having a circular edge with a disc ledge and a domed surface, the disc ledge coupled to one side of the piston, at least a portion of the disc being exposed to the inner bore, the disc dividing the inner bore into two volumes, each volume in fluid communication with the wellbore tubular's inner conduit; the disc being exposed on each of its sides to fluid pressures exerted by fluid in the wellbore tubular at the interface;

the disc being coupled to the piston by at least a lo-hi seal on a first side of the disc between the piston and the disc's ledge; the apparatus further comprising a vented centering and seating ring; and the body being made of multiple parts that may be detached and re-attached at one or more joints, whereby attachment of one such part may hold and seal the disc, the lo-hi seal, the vented centering and seating ring to the piston.

2. The apparatus of claim 1, wherein:

the disc has a weakened portion in its body at a junction of the disc's circular edge with the disc ledge; and the disc has a circumferential groove with a circumference approximately equal to an inner diameter of the disc ledge disposed about where the domed surface meets an outer surface of the disc ledge.

3. The apparatus of claim 2, wherein the disc ledge includes a ring sized to permit a guillotine to strike the disc's body while preventing at least a portion of the broken disc from entering the wellbore tubular.

4. The apparatus of claim 2, wherein a guillotine and disk ledge collide and the entire disc breaks away and is removed.

5. The apparatus of claim 1, further comprising:

a guillotine disposed on an inner ledge inside the inner bore, with a disc cutting shape of an end of the guillotine toward the side of the disc toward the direction in which the piston is slideable when the détente is released; and the guillotine being positioned such that when the détente means release the piston, the piston and its attached disc are forced to move, whereby surface of the disc inside the disc ledge is struck onto the cutting shape of the guillotine and the disc is thereby broken, permitting fluid communication between both sides of the apparatus through the inner bore.

6. The apparatus of claim 5, wherein the guillotine includes one or more fluid vents near an end of the guillotine opposite the end with the cutting shape for breaking the disc, the fluid vents permitting fluid displaced by movement of the piston and disc in the cylinder of the bore when released, to escape into the central bore.

7. The apparatus of claim 5, wherein the disc is coupled to the piston by at least a lo-hi seal on a first side of the disc between the piston and the disc ledge; the apparatus further comprising a vented centering and seating ring, and an engagement ring threadably attached to the inner bore on a second side opposite the first side of the disc ledge; the engagement ring having an internal opening with an inside diameter larger than the outside diameter of the guillotine.

8. The apparatus of claim 7, wherein the body is made of multiple parts that are coupleable together, a first part of the multiple parts including a wall, a bore, and an inner ledge, and a second part of the multiple parts including a cylinder shape to hold the disc, lo-hi seal, and vented centering and seating ring in place relative to the piston.

9. The apparatus of claim 5, wherein, when the disc is broken, the disc ledge is captured between the guillotine, a recessed inner surface of the inner bore, and a radial surface of the engagement ring.

10. The apparatus of claim 5, further comprising a second disc, wherein the guillotine is configured to impact the first disc and the second disc is configured to be pressure-breakable.

11. The apparatus of claim 1, further comprising a space into which the piston can move after the détente is released.

12. The apparatus of claim 1, wherein the body is made of multiple parts that are coupleable together.

13. The apparatus of claim 1, further comprising attachment means at two ends of the apparatus for attaching to the wellbore tubular.

14. The apparatus of claim 1, wherein the inner bore has a larger inner diameter than the outer diameter of the piston, thereby defining a gap between the body and the piston, further comprising a seal in the gap.

15. A method for pressure control using the apparatus of claim 1, comprising:

injecting a tubing string partway into a vertical portion of a wellbore;

adding the apparatus inline into the tubing string;

injecting the tubing string and the apparatus further into the wellbore;

adding a packer to the tubing string;

injecting the tubing, the apparatus, and the packer further into the wellbore;

actuating the packer to seal the annulus between the tubular and the wellbore to set the packer and form the annular seal at a desired depth into the wellbore; and injecting fluid against the disc of the invention at a pressure which releases the détente means of the apparatus and causes a guillotine to impact the disc to break the disc and open the inner conduit of the tubular.

16. A method for pressure control using two of the apparatus of claim 1, comprising:

adding the first of the two apparatus, with the convex side of the disc oriented toward the bottom of the wellbore, to the bottom of a tubing string and injecting the tubing string into the wellbore;

filling the tubing string with a low-density fluid, and adding the second of the two apparatus, with the convex side of the disc oriented toward the bottom of the wellbore, to the tubing string into the wellbore;

injecting the tubing string a further pre-determined distance into the wellbore, adding high-density fluid into the tubing string above the uppermost of the two apparatus; and with the tubing string in a desired position in the well, operating surface equipment to apply force onto one side of the uppermost apparatus sufficient to release the uppermost apparatus' détente to thereby break the disc.

17. The method of claim 16, further comprising continuing to apply pressure in the tubing conduit sufficient to release the lowermost apparatus' détente.

* * * * *